United States Patent [19]

Martenson

[11] 4,015,581

[45] Apr. 5, 1977

[54] FIREPLACE HEATER

[76] Inventor: Donald S. Martenson, Rte. 1, Box 20-A, Beavercreek, Oreg. 97004

[22] Filed: Mar. 20, 1975

[21] Appl. No.: 560,218

[52] U.S. Cl. ..... 126/121; 126/123

[51] Int. Cl.[2] ..... F24B 1/18

[58] Field of Search ..... 126/121, 123, 138, 129, 126/131, 200; 237/51

[56] References Cited

UNITED STATES PATENTS

| | | | |
|---|---|---|---|
| 525,208 | 8/1894 | Hinds | 126/123 |
| 1,433,520 | 10/1922 | Aizpuru | 126/121 |
| 1,718,859 | 6/1929 | Hanawalt | 126/121 |
| 1,740,996 | 12/1929 | Muir | 126/121 |
| 1,822,091 | 9/1931 | Hallert | 126/121 |
| 2,703,567 | 3/1955 | Manchester | 126/121 |
| 2,707,946 | 5/1955 | Merryweather et al. | 126/200 |
| 2,747,568 | 5/1956 | Dupler | 126/121 |
| 3,277,882 | 10/1966 | Rose | 126/121 |
| 3,368,545 | 2/1968 | Ibbitson | 126/121 |
| 3,372,689 | 3/1968 | Goudy | 126/140 |

FOREIGN PATENTS OR APPLICATIONS

| | | | |
|---|---|---|---|
| 617,901 | 4/1956 | Canada | 126/121 |

*Primary Examiner*—John J. Camby
*Assistant Examiner*—Larry I. Schwartz
*Attorney, Agent, or Firm*—Klarquist, Sparkman, Campbell, Leigh, Hall & Whinston

[57] ABSTRACT

A fireplace heater includes a metal firebox with a small chimney and front access and draft openings, the former being closed by glass doors. A sheet metal jacket with an open front surrounds the walls of the firebox to provide air conducting spaces between the firebox and jacket. Air baffles extend between the opposite sidewalls of the firebox and jacket to subdivide the air space into interconnected cold air intake passages below the baffle and a warm air discharge passage above the baffle. The interior of the firebox includes a series of baffles designed to retain heat within the firebox and promote the transfer of heat through the firebox walls into the air passages. Air diverters are also provided along the periphery of the firebox access opening for diverting draft air across the inside of the glass access doors to keep smoke from clouding the glass. A decorative grille front covers the jacket air intake and discharge openings and extends beyond the jacket to also cover the fireplace opening. Room air passes through the grillework into the jacket but is blocked from entering the fireplace opening beyond the jacket.

2 Claims, 6 Drawing Figures

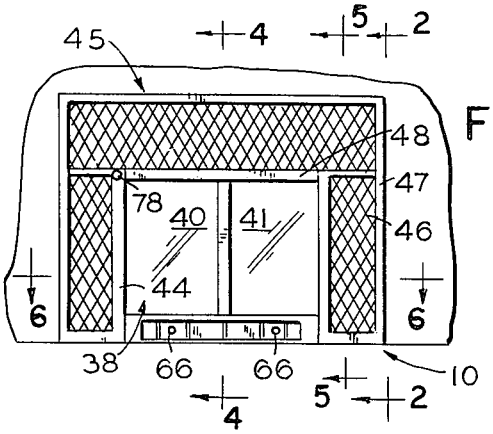
FIG. 1
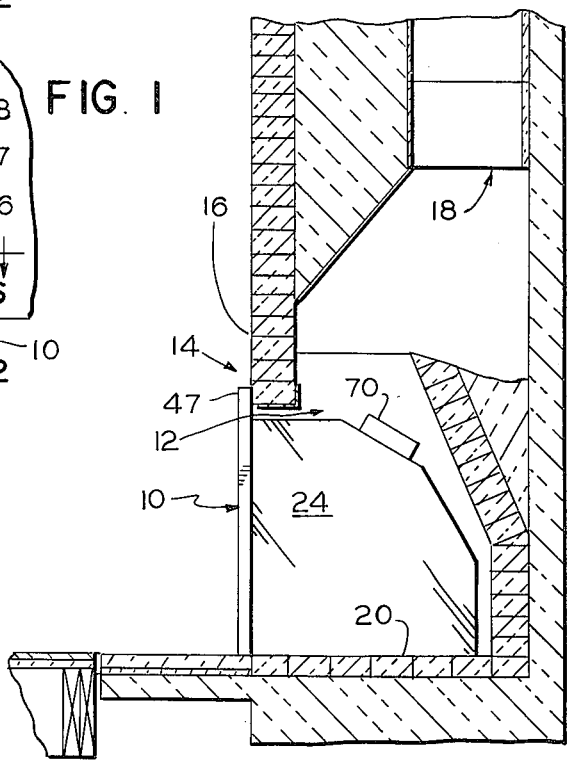
FIG. 2
FIG. 3
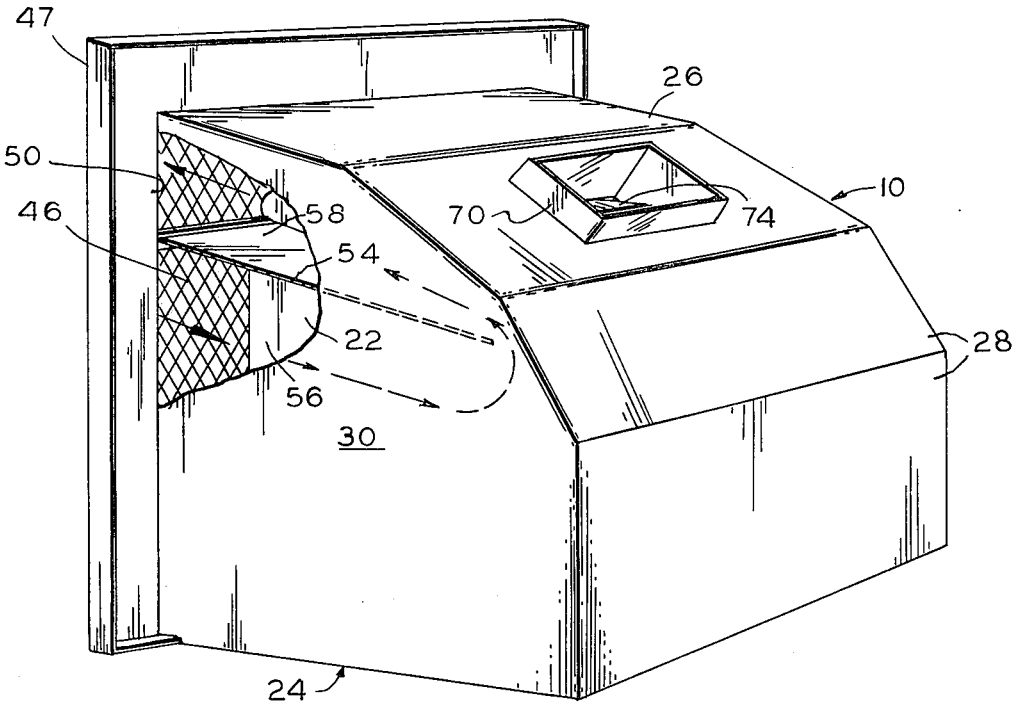

FIREPLACE HEATER

BACKGROUND OF THE INVENTION

1. Field of the Invention

The present invention relates to a fireplace heater, and more particularly to a self-contained fireplace heater particularly adapted for insertion within existing conventional fireplaces.

2. Description of the Prior Art

Fireplace heaters of the "heatalator" type are well known in which the fireplace itself is built with special heat outlet openings in the front wall of the fireplace above the fireplace opening. Heat produced within the fireplace is diverted from the fireplace chimney and exhausted out into a room through such openings.

Various other types of fireplace heaters are also known, but all of these require either rebuilding or modification of an existing fireplace or installation of the heater during the original construction of the fireplace.

Because of the above characteristics of prior fireplace heaters, they are difficult and expensive to install and beyond the financial means of many households. Therefore, most fireplaces today are not equipped with fireplace heaters. As a result, most of the heat generated within fireplaces is exhausted up the fireplace chimney as waste heat despite the critical need for fuel and energy conservation. If such waste heat energy could instead be used as a source of room heat, more efficient use of a home heating system would result and considerable cost and fuel savings could be effected.

Accordingly, there is a need for an economical and efficient fireplace heater which is easy to install in existing fireplaces.

SUMMARY OF THE INVENTION

The present invention is a self-contained prefabricated fireplace heater which can be easily installed in existing fireplaces without modification of those fireplaces. The fireplace heater of the invention can also be easily adapted for use with existing fireplaces of various sizes and shaped.

Principal objects of the invention, therefore, are to provide a fireplace heater which can be prefabricated, which is self-contained, which can be simply inserted in existing fireplaces without modification of such fireplaces, and which is an efficient room heater.

Other objects are to provide a fireplace heater that is inexpensive to manufacture and install and relatively maintenance free.

Another important object is to provide a fireplace heater that is attractive in appearance and that retains the aesthetic appeal of conventional fireplaces.

An ultimate object is to provide a fireplace heater that conserves and utilizes heat normally wasted, therefore conserving fuels normally required to heat a home.

The fireplace heater of the present invention is characterized by a metal firebox having glass front access doors, a controllable draft opening below such doors and a small chimney for discharging products of combustion into the fireplace chimney. The firebox is surrounded by a jacket with walls spaced from the walls of the firebox to provide an airspace between the firebox and jacket within which room air is heated before being discharged back into the room. The jacket is provided with an open front and baffles extending between the sidewalls of the jacket and firebox to subdivide the airspace into a lower cold air passage into which room air is drawn and a warm air passage from which air heated within the jacket is discharged back to the room by natural convection. A grille front covering the front opening of the jacket airspaces also covers the fireplace opening to prevent room air from passing into such opening. A draft air diverter means within the firebox diverts draft air across the inside surface of the glass access doors to keep such doors clear of smoke. A system of baffles within the firebox is designed to divert heat away from the chimney and access openings and concentrate the heat along the walls of the firebox to promote heat transfer through such walls into the jacket airspaces.

The foregoing and other objects, features and advantages of the present invention will become more apparent from the following detailed description which proceeds with reference to the accompanying drawings.

BRIEF DESCRIPTION OF THE DRAWINGS

In the drawings:

FIG. 1 is a front elevational view of a fireplace heater in accordance with the invention shown inserted within an existing fireplace opening;

FIG. 2 is a vertical sectional view through a typical fireplace taken along the line 2—2 of FIG. 1 and showing a fireplace heater of the invention installed within such fireplace;

FIG. 3 is a perspective view of the fireplace heater of FIGS. 1 and 2 on a slightly enlarged scale as viewed toward the rear and one side thereof with an outer sidewall portion of the jacket removed;

DETAILED DESCRIPTION

Figure 4:
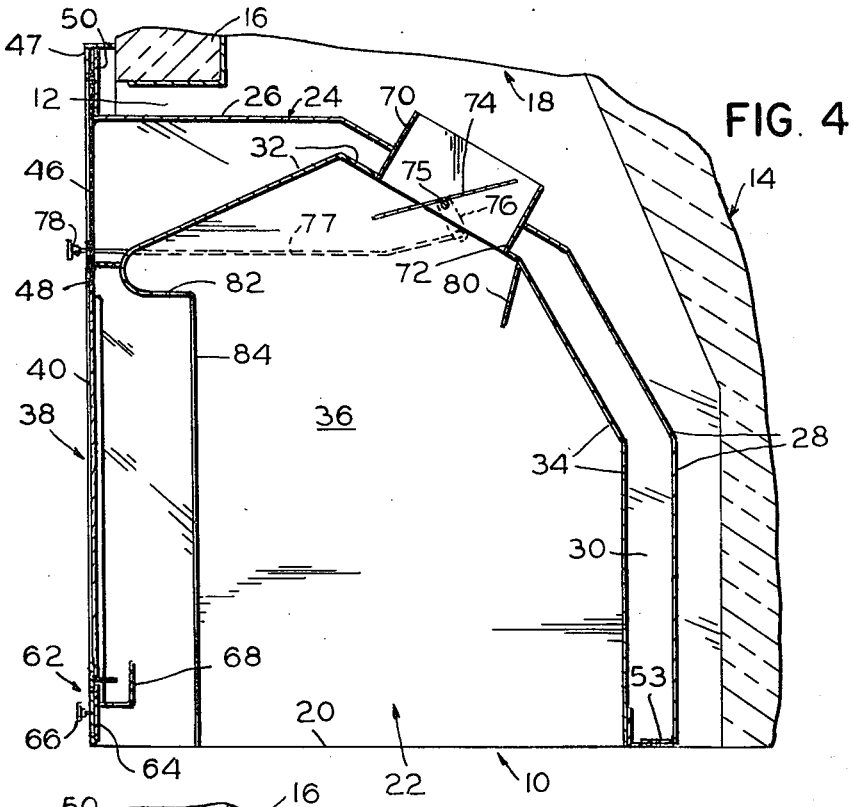
FIG. 4 is a vertical sectional view taken along the line 4—4 of FIG. 1.

Referring first to FIGS. 1 and 2, the fireplace heater of the invention comprises a unitary self-contained structure 10 which is prefabricated and then inserted into the front opening 12 of an existing fireplace 14 having the usual exterior wall 16, fireplace chimney 18, and brick fireplace floor 20.

Referring now to FIGS. 3–6, the fireplace heater includes a metal firebox 22 surrounded by a sheet metal jacket 24. The jacket has a top wall 26, rear wall 28, and opposite sidewalls 30 spaced from corresponding walls 32, 34, 36 of the firebox to provide air-conducting spaces between the firebox and the jacket.

The firebox has a front access opening 38 at the front opening of the fireplace. The front of the jacket is also open to provide for the entrance and exit of room air to and from the air conduction spaces within the jacket.

The front access opening of the firebox has a pair of hinged access door panels 40, 41 held within rectangular metal door frames 44 hinged along their vertical side edges at 42, 43 to a front grille frame 47 to provide for selective access into the firebox. The door panels are made of glass or other suitable heat-resistant, transparent material. A grille front 45, shown best in FIG. 1, covers the front opening of the jacket and fireplace opening and surrounds the firebox access opening 38. The grille front includes the grillework 46 affixed to the surrounding grille frame 47. Grille frame 47 is joined to the jacket along its bottom edge and is joined to the upper front edge of the top wall of the firebox along an intermediate horizontal frame member 48 of the grille.

Grillework 46 is preferably of a decorative screening material which permits room air to enter and exit from the air conduction spaces between the jacket and the firebox. However, as shown in FIG. 3, that portion of the grillework that extends outwardly beyond the limits of the jacket is backed with sheet material 50 which blocks room air from entering the fireplace opening between the jacket and the walls of the fireplace.

As evident from FIGS. 2, 4, 5 and 6, the jacket and firebox are sized so that they can readily be inserted as a unit into the fireplace opening. Because most conventional fireplace sidewalls, shown at 52 in FIG. 6, taper inwardly from front to back, the sidewalls 30 of the jacket 24 also preferably taper inwardly from its front opening to its back wall 28 to fit readily within the fireplace.

The bottom of the firebox itself is open so that when the heater is placed within a fireplace, bottom wall 20 of the fireplace forms the bottom wall of the firebox on which the fire may be built. Of course, if desired the wood or other fuel may be supported on andirons or in a fireplace basket placed within the firebox.

The jacket, however, has a bottom wall 53 which extends from the lower edges of its opposite sidewalls 30 and rear wall 28 to the lower edges of the corresponding walls of the firebox where such bottom wall is joined to the firebox. Since the jacket and firebox are also mutually connected to the grille frame, the jacket and the firebox are of unitary construction and can be prefabricated as such and then transported and installed as a unit into an existing fireplace. As will be seen from FIG. 2, the grille frame 47 can be made slightly larger than most fireplace front openings so that when installed it will overlap slightly the fireplace opening and butt against the front fireplace wall 16 to make certain that there will be no gap between the grille front and the fireplace opening. In this way there is no appreciable air loss into the fireplace opening around the grille frame and jacket, and thus room air will be drawn only into the firebox and jacket for maximum operating efficiency.

Figure 5:
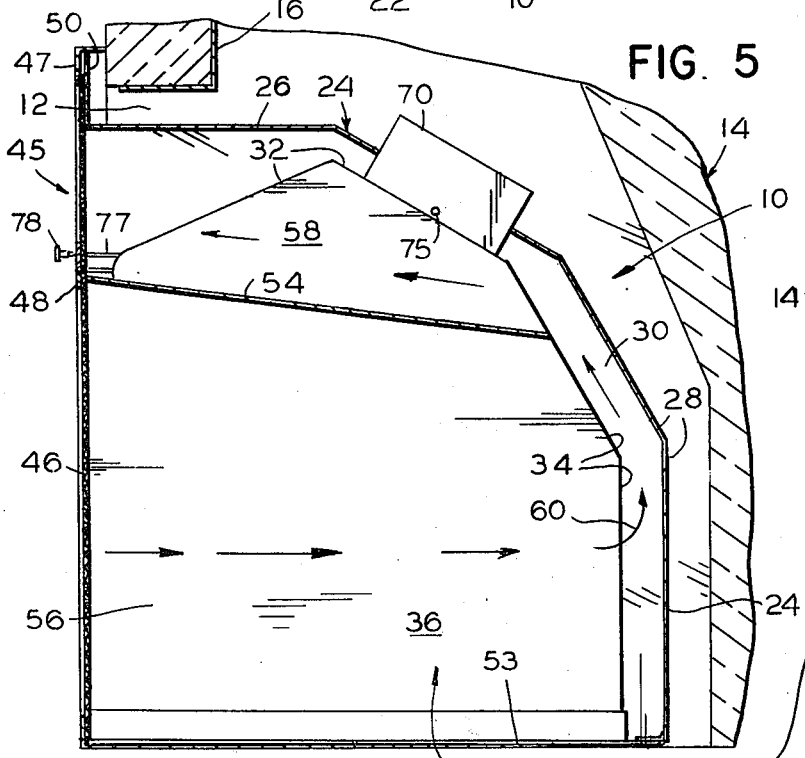
FIG. 5 is a vertical sectional view taken along the line 5—5 of FIG. 1.
Figure 6:
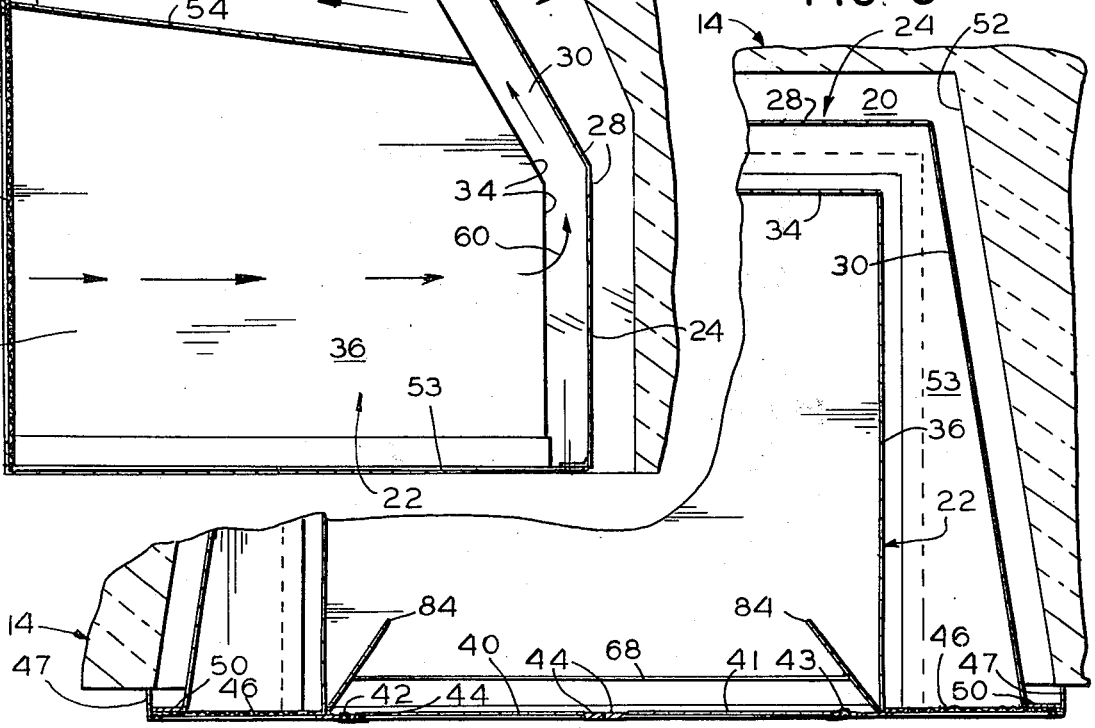
FIG. 6 is a horizontal partial sectional view taken along the line 6—6 of FIG. 1.

As clearly shown in FIGS. 3 and 5, an air baffle 54 extends transversely from an upper portion of the opposite sidewalls 36 of the firebox to the corresponding walls 30 of the jacket and rearwardly from the front opening of the jacket to subdivide the air-conducting space within the jacket into a lower cold air-conducting space or passage 56 and an upper warm air-conducting space or passage 58. There are a pair of such baffles 54, one at each of the opposite sides of the jacket. These baffles terminate at their rear edges short of rear wall 28 of the jacket. Thus cold room air entering the front of the jacket below the baffles 54 will pass rearwardly within the cold air passage and then upwardly around the baffles to the warm air passage near the rear wall of the jacket, gradually being warmed as it progresses. The warmed air will then move forwardly through such upper passage as it continues to gather heat, finally being discharged from the front of the jacket above baffles 54 into the room. The path of the air within the jacket, as described, is indicated by the arrows 60 in FIG. 5.

Turning now to FIG. 4 showing the interior details of the firebox, the firebox has a chimney 70 extending upwardly from a chimney opening 72 in an upper wall portion 32 for discharging products of combustion from the firebox upwardly toward chimney opening 18 of the fireplace. The chimney opening has a manually operable damper plate 74 for varying the effective size of such opening and thus the draft and heat within the firebox. Damper 74 is pivoted to opposite sides of the firebox at 75 and includes a downwardly extending lever arm 76 to which is pivoted a long control rod 77. The control rod extends forwardly from the pivot connection and through the upper front of the firebox to a damper-operating handle 78 outside the box.

The front of the firebox includes a draft air opening at 62 below access opening 38 and doors 40, 41. The size of the draft air opening 62 is controlled by a sliding closure member 64 behind the opening within the firebox and operated from outside the firebox by a handle 66. The draft opening 62 is slotted and the draft closure 64 is also slotted and slidable laterally with respect to the fixed slots of the draft opening. When the slots of the closure are in register with the slots of the draft opening, there will be a maximum draft air intake, but when the ribs of the closure cover the slots of the draft opening, there will be no draft air intake into the firebox.

Affixed to the rear of closure 64 is an upwardly extending draft air intake diverter member 68 which diverts incoming draft air upwardly across the inside surface of the glass doors 40, 41 thereby keeping smoke within the firebox away from the glass and preventing it from becoming clouded. Additional air diverter members may be provided along the sides and top of the access opening for the same purpose.

A system of baffles is also provided within the firebox. The purpose of the baffle system is to concentrate the heat and flame within the firebox along the walls thereof to promote heat transfer into the jacket air spaces and to divert heat, smoke and flame away from the front access opening.

The baffle system includes a flame deflector baffle 80 extending downwardly into the firebox from an upper rear wall portion rearwardly of chimney opening 72. This baffle deflects heat and flame away from the chimney opening and downwardly along the rear walls of the firebox to promote heat transfer through such walls into the air space between such walls and the jacket.

A header baffle 82 extends across the upper front of the firebox below the leading edge of the top wall 32. This baffle diverts smoke and heat away from the front access opening and doors of the firebox and concentrates heat along upper wall 32, thereby promoting heat transfer through such wall into the warm air passage of the jacket.

A pair of side baffles 84 extend angularly inwardly from the front corners of the firebox and from top to bottom of the firebox along the opposite sides of the front access openings. These baffles divert smoke and heat away from the access doors and opening and direct heat along the opposite sidewalls of the firebox to promote heat transfer through such walls into the air spaces between such walls and the jacket.

Operation

The heater as described is prefabricated by the manufacturer with the firebox and jacket as an integral self-contained unit. The heater unit is then transported to the point of installation and simply inserted into the fireplace opening 12 until the grille facing engages the front face walls of the fireplace. With the heater thus installed, it is ready for operation, first making certain that damper 74 is open.

A fire is started in the firebox and the access doors are closed. The draft closure 64 is adjusted to permit draft air to enter the firebox and keep the fire burning. As the firebox walls heat up, the heat from such walls is transferred into the air spaces between the firebox and the jacket. Without the air of any blowers or fans, natural air convection currents are set in motion, causing cool room air to enter the cold air passages of the jacket below the opposite side baffles 54. As this air passes rearwardly below such baffles, it is gradually heated both by direct contact with the hot sidewalls of the firebox and by radiation of heat from such walls into the passages. The progressively warming air rises as it proceeds rearwardly, passing upwardly around the rear ends of such baffles and then forwardly in the warm air passage above the baffles, continuing to warm as it moves. Finally the warmed air flows out of the upper warm air passage through the front opening of the jacket above baffles 54 back into the room.

The circulation of air from the room through the jacket air spaces and back to the room continues so long as the walls of the firebox remain hot through maintenance of a fire within the firebox. The firebox walls thus serve as a heat exchanger, with the air spaces between the jacket and the firebox serving as the plenum for such exchanger.

In practice, it has been found that only a very small fire need be maintained within the firebox to provide a maximum heat output. Because of the action of the baffles within the firebox diverting heat and flame away from the chimney and access openings and toward its walls, the firebox operates at optimum efficiency with minimum heat loss through the chimney opening. Yet smoke and other products of combustion are discharged through the chimney, and the baffles and air diverters prevent the door glass from becoming clouded. Thus persons within the room are kept comfortably warm while still being able to enjoy the sight of the fire.

The illustrated shape of the jacket and firebox is not critical but is for the purpose of fitting the heater within a fireplace opening of conventional configuration. Such shape may be modified to conform with the shape of a particular fireplace opening. In practice is has been found that the fireplace heater can be prefabricated in standard sizes to fit most fireplaces. For exceptionally small or large fireplaces, the firebox still can be built to standardized dimensions with only the jacket or grille front requiring modification to fit such exceptional fireplaces.

Having illustrated and described what is presently a preferred embodiment of the invention, it will be apparent to those skilled in the art that such embodiment may be modified in arrangement, detail and configuration without departing from the broad aspects of the inventive concept disclosed. I claim as my invention all such modifications and equivalents that come within the true spirit and scope of the following claims.

I claim:

1. A self-contained fireplace heater adapted for insertion within existing fireplaces comprising:

a metal firebox including a firebox chimney for exhausting products of combustion from said firebox into a fireplace chimney, a front access opening for positioning at the front of a fireplace, a controllable draft opening below said access opening, and access door means for closing said access opening to retain within said firebox heat from a fire therewith, a jacket surrounding and integral with said firebox including wall portions spaced laterally and vertically outwardly from corresponding wall portions of said firebox to provide an air conduction space between said firebox and said jacket, said jacket having an open front at the front of said firebox, and baffle means extending transversely from opposite sidewalls of said jacket to corresponding opposite sidewalls of said firebox to subdivide said air conduction space into cold air intake passage means below said baffle means and warm air exhaust passage means above said baffle means, said baffle means providing for communication between said cold and warm air passages at the rear interior of said jacket, said access door means comprising transparent heat-resistant front access door panel means at the front access opening of said firebox selectively operable to open and close said front access opening, said firebox including opposite vertically extending sidewalls extending rearwardly from said front access opening, a generally vertically extending rear wall portion joining the rear ends of said opposite sidewall portions and an upper wall joining the upper ends of said sidewalls and rear and wall, said upper wall including a front upper wall portion sloping upwardly and rearwardly from adjacent the upper end of said front access opening and a rear upper wall portion sloping downwardly and rearwardly from the rear end of said front upper wall portion to the upper end of said rear wall to provide the upper portion of said firebox with a domed effect, said baffle means between said jacket and firebox sidewalls extending rearwardly from the upper end of said front access opening to an upper rear wall portion of said firebox so that the vertical extent of said intake passage means is substantially greater than the vertical extent of said exhaust passage means, said intake passage means having intake openings at opposite sides of said firebox access opening extending continuously vertically from the lower ends of said firebox sidewalls to the front edges of said baffle means.

2. A self-contained fireplace heater adapted for insertion within existing fireplaces comprising:

a metal firebox including a firebox chimney for exhausting products of combustion from said firebox into a fireplace chimney, a front access opening for positioning at the front of a fireplace, and access door means for closing said access opening, a jacket surrounding said firebox including wall portions spaced outwardly from corresponding wall portions of said firebox to provide an air conduction space between said firebox and said jacket, said jacket having an open front at the front of said firebox, and baffle means extending transversely from opposite sidewalls of said jacket to corresponding opposite sidewalls of said firebox to subdivide said air conduction space into a cold air intake passage below said baffle means and a warm air exhaust passage above said baffle means, said baffle means providing for communication between said cold and warm air passages at the rear interior of said jacket, a perforate front grille means extending from the front access opening of said firebox across the open front of said jacket and terminating beyond opposite sidewall and top wall portions of said jacket to cover a front opening of a fireplace in which said heater is inserted, said grille means being blocked outwardly of said jacket to prevent room air from entering the fireplace opening, transparent glass access door means for said access opening including means for selectively opening and closing said access door means, a draft opening and draft closure means below said access opening for regulating the draft air intake into said firebox, horizontally extending air diverter means positioned within a front portion of said firebox below said access opening and across said draft opening for diverting a portion of the draft intake air upwardly across the inside surface of said glass door means to prevent clouding of said glass, chimney baffle means within said firebox extending downwardly from an upper wall portion of said firebox rearwardly of a firebox chimney opening and forwardly of a rear wall portion of the firebox to divert heat and flame downwardly away from said chimney opening and along said rear wall portion of said firebox to promote heat transfer through said rear wall portion, header baffle means within said firebox extending generally horizontally inwardly from an upper front portion thereof above said access opening and below an upwardly and rearwardly sloping upper wall portion of said firebox forwardly of a chimney opening of said firebox for diverting heat and smoke away from said access opening and along said upper wall portion of said firebox for promoting heat transfer through said upper wall portion, said header baffle means terminating at a rear edge forwardly of said chimney opening and said rear wall portion, and a pair of side baffle means within said firebox extending vertically and diagonally inwardly along opposite sides of said access opening and extending from a lower to an upper portion of said firebox for diverting smoke and heat away from said access opening and along opposite sidewll portions of said firebox for promoting heat transfer through said sidewall portions.

* * * * *